US008496107B2

(12) United States Patent
Gallagher

(10) Patent No.: US 8,496,107 B2
(45) Date of Patent: Jul. 30, 2013

(54) RE-CLOSABLE CONTAINER WITH INTEGRATED FINGERS

(75) Inventor: Robert Gallagher, Grapevine, TX (US)

(73) Assignee: Rockaway Tucker International, Inc., Grapevine, TX (US)

( * ) Notice: Subject to any disclaimer, the term of this patent is extended or adjusted under 35 U.S.C. 154(b) by 70 days.

(21) Appl. No.: 12/893,766

(22) Filed: Sep. 29, 2010

(65) Prior Publication Data

US 2012/0076440 A1 Mar. 29, 2012

(51) Int. Cl.

| | |
|---|---|
| ***A61B 17/06*** | (2006.01) |
| ***B65D 73/00*** | (2006.01) |
| ***B65D 30/00*** | (2006.01) |
| ***B65D 33/16*** | (2006.01) |

(52) U.S. Cl.

USPC ..... 206/63.3; 206/438; 383/4; 383/63

(58) Field of Classification Search

USPC ..... 206/63.3, 278, 438; 2/16, 158–160, 2/161.6–161.8; 294/1.3, 25; 312/1, 3; 383/4, 383/63

See application file for complete search history.

(56) References Cited

U.S. PATENT DOCUMENTS

| | | | | |
|---|---|---|---|---|
| 3,372,799 | A * | 3/1968 | Abildgaard | 206/278 |
| 3,391,406 | A | 7/1968 | Lucas | |
| D297,474 | S | 8/1988 | Jiracek | |
| 4,937,881 | A * | 7/1990 | Heise | 294/1.3 |
| 5,671,983 | A * | 9/1997 | Miller et al. | 312/1 |
| 5,704,670 | A * | 1/1998 | Surplus | 294/25 |
| 5,961,167 | A * | 10/1999 | Gilley | 294/1.3 |
| 6,050,726 | A | 4/2000 | Hoerl | |
| 6,237,971 | B1 * | 5/2001 | Ward Gilley | 294/1.3 |
| D445,963 | S | 7/2001 | Derosa | |
| D450,575 | S * | 11/2001 | Porter | D7/709 |
| 6,539,549 | B1 * | 4/2003 | Peters, Jr. | 2/16 |
| D533,314 | S | 12/2006 | Schiazza | |
| D555,009 | S | 11/2007 | Lin | |
| D557,148 | S | 12/2007 | Kapinos | |
| D563,241 | S | 3/2008 | Nimey | |
| D602,377 | S | 10/2009 | Lin | |
| D613,615 | S | 4/2010 | Hedstrom | |
| D617,654 | S | 6/2010 | Tawinsook | |
| D623,075 | S | 9/2010 | Blythe | |
| D623,536 | S | 9/2010 | Bohmke | |
| D633,809 | S | 3/2011 | Bradley | |
| D634,645 | S | 3/2011 | LaFuci et al. | |
| D644,535 | S | 9/2011 | Gallagher | |
| 8,128,287 | B2 * | 3/2012 | Song et al. | 383/4 |
| D666,921 | S | 9/2012 | Gallagher | |

(Continued)

FOREIGN PATENT DOCUMENTS

| | | |
|---|---|---|
| EM | 001268833-0001 | 3/2011 |
| EM | 001268833-0002 | 3/2011 |

(Continued)

*Primary Examiner* — Bryon Gehman

(74) *Attorney, Agent, or Firm* — Patent Capital Group

(57) ABSTRACT

Methods and apparatus for grasping an object using a re-closable bag with integrated finger sleeves. The re-closable bag includes a flexible side panel, an opening on a top end of the bag, and at least two flexible finger sleeves connected to the side panel. The opening includes a closure adapted, when closed, to seal the bag. The at least two flexible finger sleeves, when in a first position, are disposed between a first portion and a second portion of the side panel. Each finger sleeve in the two or more finger sleeves is adapted to accept at least a portion of a human finger. In some aspects, an object grasped using the finger sleeves can be retracted into the re-closable bag with integrated finger sleeves and stored within the bag.

27 Claims, 6 Drawing Sheets

U.S. PATENT DOCUMENTS

| | | | | |
|---|---|---|---|---|
| 2002/0178482 | A1 | 12/2002 | Samuelsson et al. | |
| 2003/0127950 | A1* | 7/2003 | Tseng et al. | 312/1 |
| 2003/0127952 | A1* | 7/2003 | Friedenbach | 312/1 |
| 2004/0027036 | A1* | 2/2004 | Hall | 312/1 |

FOREIGN PATENT DOCUMENTS

| | | |
|---|---|---|
| EM | 001268833-0003 | 3/2011 |
| EM | 001268833-0004 | 3/2011 |
| WO | WO 91/03954 | 4/1991 |

* cited by examiner

RE-CLOSABLE CONTAINER WITH INTEGRATED FINGERS

TECHNICAL FIELD

This document relates to containers, and more particularly re-closable bags.

BACKGROUND

A number of removable dental appliances, mouthpiece devices, and similar medical devices have been developed to assist patients with a wide variety of ailments including bite correction, snoring, sleep apnea, bruxism, and tooth loss. Removable dental appliances can include teeth aligners, dentures, retainers, bruxism guards, night guards, snoring mouthpieces, athletic mouthguards, and other devices. Given that these devices are often placed directly in the user's mouth, such devices can be sensitive to contamination, as germs, bacteria, and viral agents can be transferred from the appliance to the user's mouth and vice versa. Further, dental appliances, like many medical devices, can be custom-designed and individually-prescribed by medical and dental health professionals. In some cases, these appliances can be quite expensive. Accordingly, many removable appliances are provided together with a carrier to safeguard the appliance while it is not in use. A common appliance carrier can take the form of a rigid plastic case adapted to enclose the appliance while protecting the appliance from falls or impact trauma. Other medical devices and tools can also be sensitive to contamination and can be provided with specialized containers to protect the devices from contamination and contact while not in use.

SUMMARY

This specification describes technologies and apparatus relating to re-closable bags with integrated finger sleeves.

In general, one innovative aspect of the subject matter described in this specification can be embodied in a re-closable bag including a flexible side panel, an opening on a top end of the bag, and at least two flexible finger sleeves connected to the side panel. The opening can include a closure adapted, when closed, to seal the bag. The at least two flexible finger sleeves, when in a first position, can be disposed between a first portion and a second portion of the side panel. Each finger sleeve in the two or more finger sleeves can be further adapted to accept at least a portion of a human finger.

These and other embodiments can each optionally include one or more of the following features. The finger sleeves, in a first position, can extend from a bottom end of the bag substantially toward the opening. Alternatively, the finger sleeves, in a first position, can extend from a side end of the bag substantially parallel with the opening. The at least two finger sleeves can comprise three finger sleeves or five finger sleeves. The finger sleeves can include a first finger sleeve and a second finger sleeve, wherein the first finger sleeve is longer than the second finger sleeve. One or more of the at least two finger sleeves can be further adapted to receive less than an entire human finger. One or more finger sleeves can be textured proximate to a tip of the finger sleeve, where the textured area is adapted to grip a surface having a low coefficient of friction. The re-closable bag can include an interior surface, including interior surfaces of the panels and the at least two finger sleeves. A coating can be disposed on at least a portion of the interior surface, the coating adapted to transfer, at least partially, to an object placed within the bag. The coating can be adapted to transfer to moistened objects placed within the bag. The object can include a removable dental appliance. The coating can be a flavored and/or antiseptic powder.

Embodiments can further optionally include finger sleeves made of at least one of vinyl, nitrile, or latex film. The finger sleeves can be made of a first material while at least a portion of the side panel is made from a second material different from the first material. The at least two finger sleeves can be joined to the side panel to form the bag. The at least two finger sleeves can be formed from at least one unitary sheet of material, and at least a portion of a particular finger sleeve can be made from the same unitary sheet of material from which at least a portion of the side panel is made. The side panel can include at least a first side panel and a second side panel. The closure can be a re-closable closure. The re-closable closure can be a resealable closure. The re-closable closure can include an adhesive strip adapted to temporarily seal the opening. The re-closable closure can include an interlocking male part disposed on the inside surface of the panel proximate to the top end of the bag and an interlocking female part disposed on the inside surface of the panel proximate to the top end of the bag, the male part adapted to couple with the female part to seal the bag. The re-closable bag can be adapted to be folded substantially flat with the at least two finger sleeves in the first position.

In general, another aspect of the subject matter described in this specification can be embodied in methods that include the actions of accepting at least two human fingers in at least two flexible finger sleeves integrated into a re-closable bag, the re-closable bag further including a flexible side panel, and an opening on a top side of the bag. The opening can include a re-closable closure adapted, when closed, to seal the bag. The at least two flexible finger sleeves can be connected to the side panel, and each finger sleeve, upon accepting one of the at least two human fingers, can extend from a bottom side of the bag substantially toward the opening and be disposed between a first portion and a second portion of the side panel. The at least two flexible finger sleeves can be extended in a direction toward and at least partially through the opening to grasp an object. The at least two flexible finger sleeves grasping the object can be retracted in a direction toward the bottom side of the bag so as to pass the article through the opening and position the article between the first portion and the second portion of the side panel. The re-closable closure can be closed to seal the object within the bag.

Further, another general aspect of the subject matter described in this specification can be embodied in a glove including a water-tight body that includes an inner surface, an outer surface, at least two inverted elastomeric finger sleeves, and a re-closable opening. The at least two inverted elastomeric finger sleeves can each have an inner and an outer surface, each finger sleeve adapted to accept at least a portion of a human finger in contact with the outer surface of the finger sleeve. The opening in the body can include a closure adapted to seal an interior volume of the glove enclosed by at least a portion of the inner surface of the body when closed.

Particular embodiments of the subject matter described in this specification can be implemented so as to realize one or more of the following advantages. For example, objects sensitive to contamination by contact with human hands, such as removable dental appliances, can be conveniently grasped and contained within a single, lightweight, and, in some cases, disposable bag including integrated finger sleeves. Further, objects can be sealed or otherwise enclosed within the bag, to further protect the enclosed object from damage and contamination. Additionally, bags can be used to call attention to items stored in the bag and mitigate against the items being forgotten or misplaced. Similarly, storing items in bags manufactured from colorful material or that include printed graphics or messages can be used to identify an owner of the bag or distinguish an important or expensive item, such as a clear dental aligner or contact lens stored in the bag, from ordinary garbage.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1A:
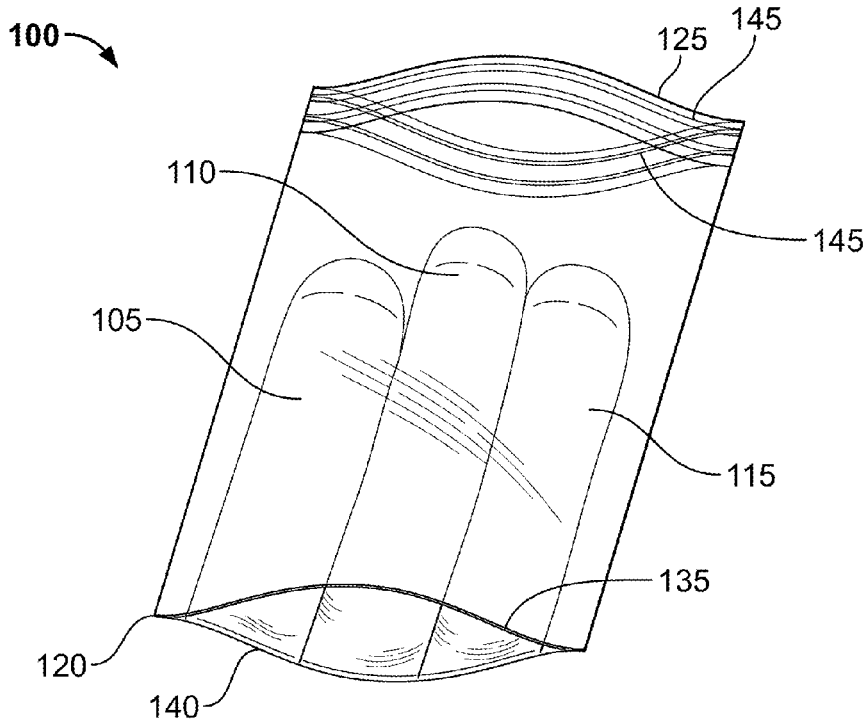
FIGS. 1A-1B illustrates a perspective view of a re-closable bag including integrated finger sleeves.
Figure 1B:
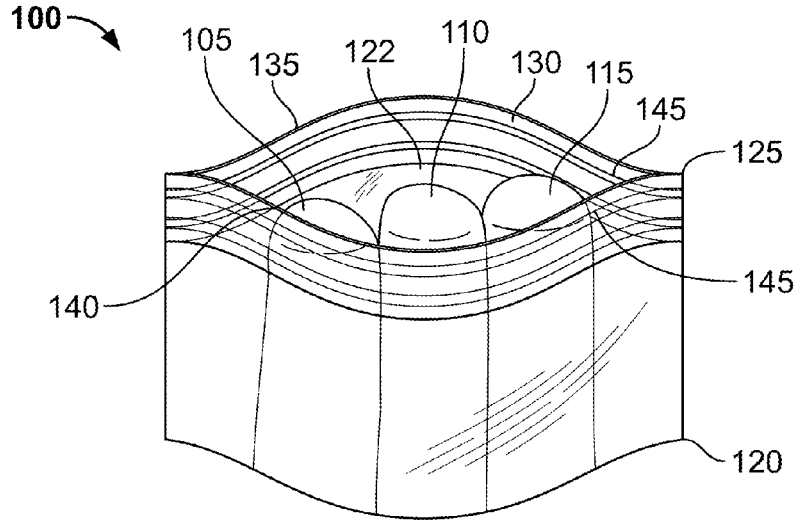

FIGS. 1A and 1B illustrate perspective views of a re-closable bag 100 including integrated finger sleeves 105, 110, 115. As shown, two or more finger sleeves (e.g., 105, 110, 115) can be integrated into a bottom end 120 of the bag 100. Each of the two or more finger sleeves (e.g., 105, 110, 115) can be adapted to receive at least a portion of a human finger, effectively allowing a portion of the finger to be covered by the sleeve. The dimensions of the finger sleeves (e.g., 105, 110, 115) can be adapted to accept all or a part of a human finger and can be adapted to various-sized hands and fingers, including adult and children fingers. In some instances, the dimensions, order, and orientations of the finger sleeves (e.g., 105, 110, 115) can be adapted to particular digits and/or thumb of a human hand, including combinations thereof. The combination of digits and/or thumb (collectively "fingers") intended for the finger sleeves (e.g., 105, 110, 115) can be adapted to perform certain grips, tasks, or other actions. Indeed, in some instances, texturing can be added to portions of the interior surface 122 of the bag, including the surface of the finger sleeves 105, 110, 115 intended to grip objects and bring them into the interior of the bag 100. For example, texturing or a coating can be added to or manufactured into a portion of the interior surface 122 including sections of the finger sleeves 105, 110, 115 corresponding to fingertips of a user, to enhance the grip and non-slip characteristics of the bag 100. In some instances, texturing or coating on the interior surface of the finger sleeves 105, 110, 115 can adapt the finger sleeves to grip object with low coefficients of friction, such as wet, smooth, or slick objects, including dental appliances.

The top end 125 of the bag can include an opening 130, that is the lone opening provided for placing objects within the bag 100. The two or more finger sleeves (e.g., 105, 110, 115) can be sealed, molded, welded, bonded, or otherwise joined to or integrated with the bottom end 120 of the bag, to provide a water-tight bottom surface of the bag 100. The bag 100 can further include a first side panel 135 and second side panel 140, each spanning from the bottom end 120 to the top end 125. In some instances, the first 135 and second 140 side panels can be made of two separate panels of material, while in other instances the first 135 and second 140 side panels can describe two sections of a single, unitary band of material.

The opening 130 can include a re-closable closure 145 adapted to close or seal the interior 122 of the bag 100 including whatever objects or contents have been placed therein. In some instances, the closure 145 can include first and second enclosure sections, such as interlocking male and female zipper sections. In other instances the closure 145 can include an adhesive or static cling strip on one or both of the interior 122 surfaces of the first 135 and second 140 side panels adapted to close and seal the opening 130. In some instances, when closed, the closure 145 can provide a water-tight and, in some cases, airtight seal for the bag 100. The closure 145 can be implemented on the interior surfaces 122 of the first and second side panels 135, 140. In some instances, the closure 145 can be bonded to the interior side panels, while in other examples, the closure 145 can be integrated into the panels 135, 140 themselves.

Figure 2A:
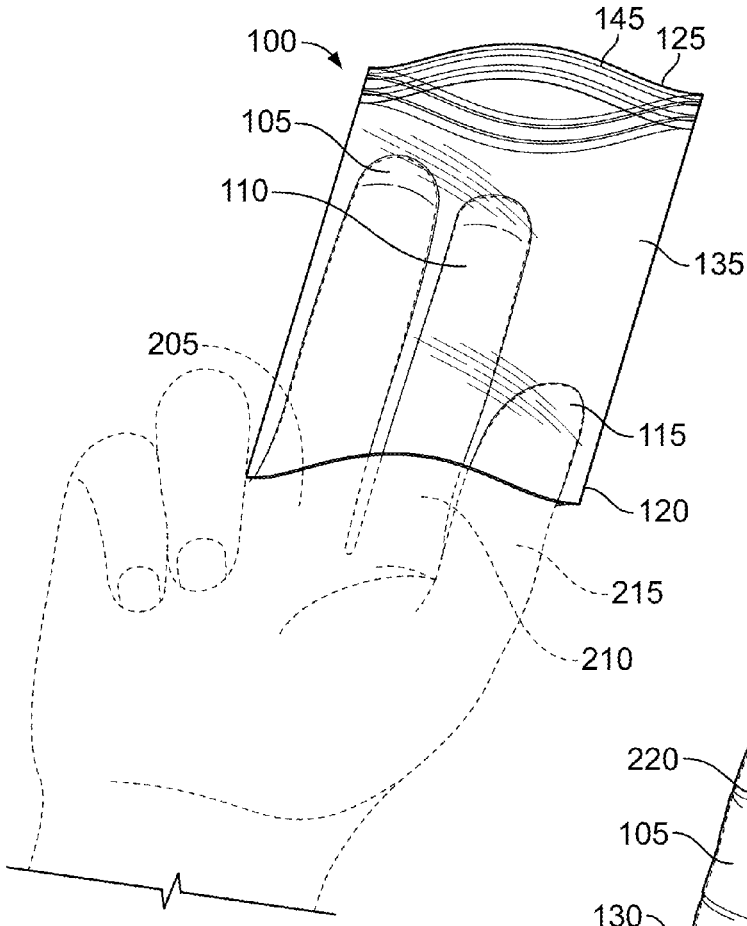
FIGS. 2A-2D illustrate an example use of a re-closable bag including integrated finger sleeves.

FIGS. 2A-2D illustrate an example use of a re-closable bag with integrated finger sleeves, such as the example shown and described in FIG. 1. As shown in FIG. 2A, the bag 100 can be in a first position, with the opening 130 (and corresponding closure 145) either open or closed, and the finger sleeves 105, 110, 115 extending up from the bottom end 120 toward the upper end 125 and positioned between side panels (e.g., 135) of the bag 100. In this position, human fingers 205, 210, 215 can be inserted into finger sleeves 105, 110, 115, respectively, thus positioning the human fingers inside the finger sleeves and "within" the bag 100 while not allowing the outer surfaces, or skin, of the fingers, to contact and potentially contaminate the interior of the bag 100.

Figure 2B:
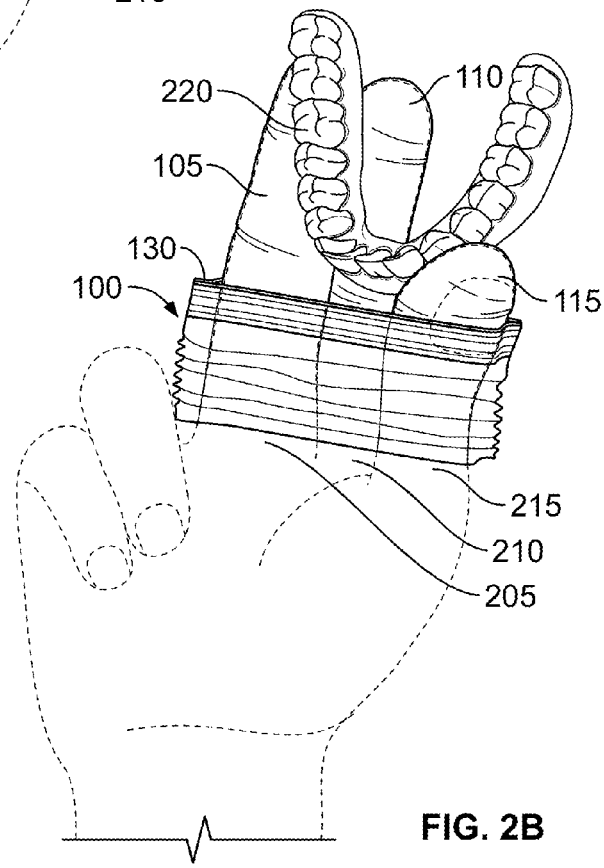
Figure 2C:
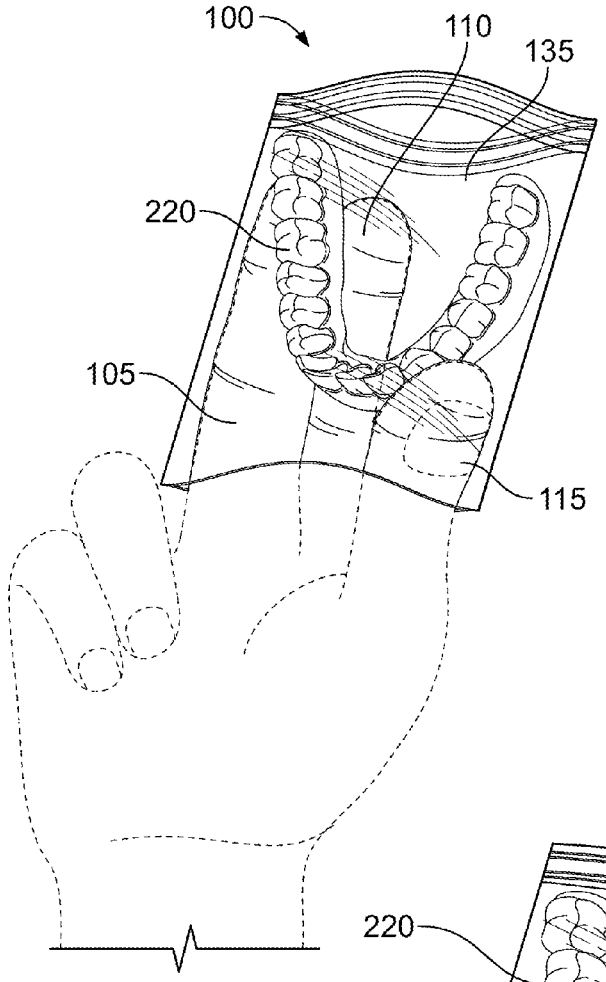
Figure 2D:
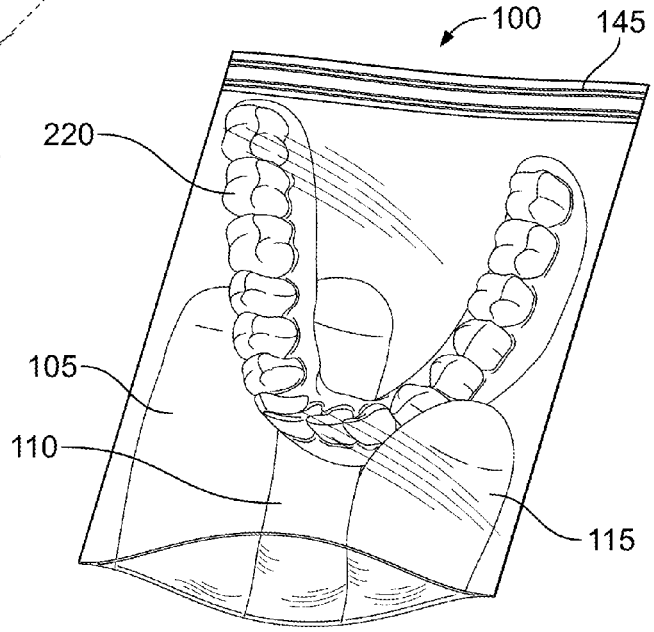

As shown in FIG. 2B, the bag 100, can be manipulated to be in a second position, with the closure 145 open and the finger sleeves 105, 110, 115 (covering fingers 205, 210, 215), extending up through the opening 130 of the bag 100. In this position, at least the portion of the finger sleeves 105, 110, 115 corresponding to the tips of human fingers can protrude through the opening 130 to grip, grab, or hold an object 220. In this sense, the finger sleeves 105, 110, 115 can act like a partial glove, integrated into the bag 100. As shown in FIG. 2C, the finger sleeves 105, 110, 115 can be returned or retracted back into the bag 100, together with the object 220, by manipulating the bag 100 into a position similar to the first position illustrated in FIG. 2A to thereby place the object 220 between the bag's side panels (e.g., 135) and within the bag. With the object 200 placed substantially entirely between the side panels of the bag 100, the closure 145 can be closed, sealed, re-closed, or resealed, as shown in FIG. 2D, to enclose, and in some cases, seal the object 220 within the interior of the bag 100. Further, with the object 220 enclosed within the bag 100, the user's fingers can be removed from the finger sleeves 105, 110, 115, thereby bringing the bag 100 into a position similar to that shown in FIG. 2D.

Using the techniques and bag 100 illustrated in FIGS. 2A-2D, an object 220 can be grasped and stored without human fingers contacting and potentially contaminating the object 220. Further, the object 220 can be removed from the bag 100 and replaced by re-opening the closure 145, reinserting the fingers into the finger sleeves 105, 110, 115, and pushing the object 220 out of the bag 100 through the bag's opening 130, all while keeping the object out of direct contact with human skin. The example bag 100 of FIGS. 1, 2A-2D was shown to include only three finger sleeves 105, 110, 115 adapted to receive only three human fingers, although other orientations, such as those shown and described below, can also be used. This orientation can be particularly adapted to grasp and store objects of a particular size. For instance, a two- or three-finger-sleeve design can be implemented, adapted to grasp and store small object using predominantly a user's thumb and forefinger.

To illustrate, as shown in FIGS. 2A-2D, the object 220 can be a removable dental appliance such as a retainer, dentures, or removable teeth aligners, such as INVISALIGN™ braces. Dental appliances are often expensive, customized medical devices prone to damage, contamination, and loss as the user is often required or allowed to occasionally remove the appliance, for instance during periods of sleep, teeth brushing, eating, athletics, and other activities. When users reach into their mouths to remove and replace the appliances, however, they risk introducing bacteria, viral agents, and other impurities into the mouth both from touching the mouth and the appliance with their bare hands, as well as during storage of the appliance. A disposable, single-use, re-closable bag with integrated finger sleeves, similar to those examples shown and described in this specification, can be used to avoid contamination of the appliance, as well as simplify storage and mitigate against loss of the appliance. A user can use a new, clean bag 100, insert their fingers into the finger sleeves 105, 110, 115, and grip and remove the appliance with their fingers gloved in the finger sleeves 105, 110, 115. The user can then pull the appliance into the bag, remove their fingers from the sleeves 105, 110, 115, and seal the bag 100 using the closure 145. The user can then slip the closed bag 100, now carrying the appliance, into their pocket or purse, or set the bag on a counter, lunch tray, or other surface while they brush their teeth or eat, rather than using a bulky, hard plastic carrier often provided with a dental appliance. When the user is ready to reinsert the dental appliance, the user can re-insert their fingers into the finger sleeves 105, 110, 115, re-open the closure 145, grasp the appliance, and push the appliance back through the opening 130 of the bag 100 and into their mouth. The user can then dispose of the bag.

A re-closable bag with integrated finger sleeves can be similarly used in connection with the removal and storage of contact lenses and other medical devices. In the example of contact lens removal, a re-closable bag 100 with at least two integrated finger sleeves can be used. For instance, a user can contact and remove a contact lens from the user's eye using an index finger inserted into one of the integrated finger sleeves. The tip of the finger sleeve can be specially coated, textured, or otherwise prepared so as to introduce sufficient surface tension between the tip of the finger sleeve and the surface of the contact lens to thereby secure the contact lens while not scratching or otherwise damaging the lens. A second finger, inserted into a second finger sleeve, can be used to assist in securing and transporting the contact lens from the user's eye to the interior 122 of the bag 100 and vice versa. Human eyes can be particularly susceptible to infection and the introduction of viral and bacterial agents into the body. Accordingly, the use of the bag 100 to remove contact lenses can help limit exposure to harmful biological agents by allowing the contact lens wearer to avoid direct contact between their fingers, their eyes and contact lenses.

A re-closable bag including integrated fingers can be adapted for and used in other environments beyond the removal and replacement of dental appliances. For instance, the bag 100 can be used in connection with other surgical, medical, and emergency response situations, where an item, substance, waste, or tool needs to be grabbed, isolated, and enclosed within a sterile environment. Applications can also include evidence handling, such as by crime scene investigators, fire investigators, and other police and public safety workers, where contamination and gathering of evidence requires minimal human contact, speed, and convenience in securing objects. Industrial applications can also be realized, such as bags adapted for handling and temporarily storing tools in clean room, food, automotive, and mechanical manufacturing environments requiring protection against contaminates. Janitorial, sanitary, and industrial workers can also use a bag with integrated finger sleeves in clean-up and waste disposal, including hazard material and industrial waste removal. Home uses can also be realized, such as bags 100 adapted to grab and conveniently handle and isolate waste such as soiled diapers, chemical solvents, soiled rags, raw meat, and other household products, among other applications.

Uses of the bag 100 can also include applications where it is desirable to protect an exterior surface of a disposable glove or finger covering from contamination prior to use. For instance, the interior surfaces 122 of the finger sleeves 105, 110, 115 of the bag 100, can be first maintained in a sealed sterile environment within the interior of the bag until the bag 100 is ready for use. After the bag closure 145 is opened and the user's fingers extend the finger sleeves through the opening 130 (e.g., as shown in FIG. 2B), the interior surface 122 of the finger sleeves exposed through the opening 130 effectively act as an "exterior" surface of a "glove" or finger covering that comes in contact with objects handled using the finger sleeves. Accordingly, prior to use, the bag 100 can serve as a self-contained package for the finger sleeves 105, 110, 115 adapted to glove a portion of a user's hand.

Application-specific features can be added or implemented in particular instances of a re-closable bag including integrated finger sleeves. For instance, the interior 122 of the bag 100 can be coated with compounds, including powders, gels, liquids, and other substances to enhance operation and characteristics of the bag 100. For example, in implementations of the bag suited for dental applications, a flavored and/or antiseptic powder can be applied to the inner surface 122 of the bag 100. In some dental applications, finger sleeves 105, 110, 115 of the bag 100 will brought in contact with a user's mouth. The flavored coating can thereby help make use of the bag 100 more pleasant, as the finger sleeves incidentally contact the user's mouth. Additionally, a flavored or antiseptic coating applied to the interior of the bag can transfer to a dental appliance removed with and stored in the bag 100, to freshen and/or disinfect the appliance between uses and during storage in the bag 100. Examples of a coating for use in connection with the removal of dental appliances can include powder- or gel-based dentifrice, such as fluoridated, antiseptic, anti-Gingivitis, flavored, or plaque-inhibiting dentifrice. Other coatings can be applied and substances added depending on the application. For instance, in an example bag adapted for the removal of contact lenses, an amount of contact lens solution can be pre-deposited in the bag, to assist in cleaning, disinfecting, or otherwise maintaining contact lenses temporarily deposited in the bag. Further, in some examples, a coating, lining, or powder (such as corn starch or other lubricant) can be applied to the surface of the finger sleeves that will be in contact with the user's fingers (i.e., not the interior 122 of the bag 100), so as to assist the user in inserting and removing fingers from the finger sleeves, or protect the user from mechanical irritation or abrasion (e.g., chapping) from repeated uses of finger sleeve-equipped bags.

FIGS. 3A-3E show various example implementations of a re-closable bag including integrated finger sleeves. For example, an implementation 300*a* of a re-closable bag including integrated finger sleeves, shown in FIG. 3A, can include three finger sleeves 301, 302, 303, each substantially equal in length and adapted to receive at least a portion of a human finger. In some instances, the length of the finger sleeves 301, 302, 303 can be intentionally adapted to receive only an upper portion of the user's fingers, as less than the entire finger may be needed to effectively grasp an object and return it to the interior of the bag. Shortened, partial finger sleeves can further serve to limit material costs and allow for bag sizes with dimensions smaller than the length of a human finger.

Figure 3A:
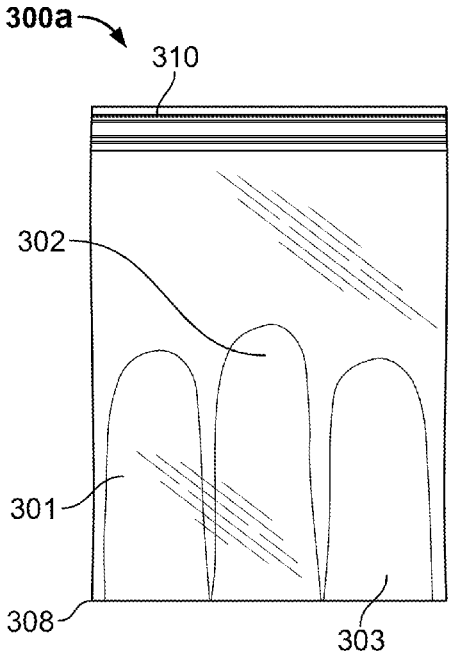
FIG. 3A illustrates a front view of a first example implementation of a re-closable bag including integrated finger sleeves.
Figure 3B:
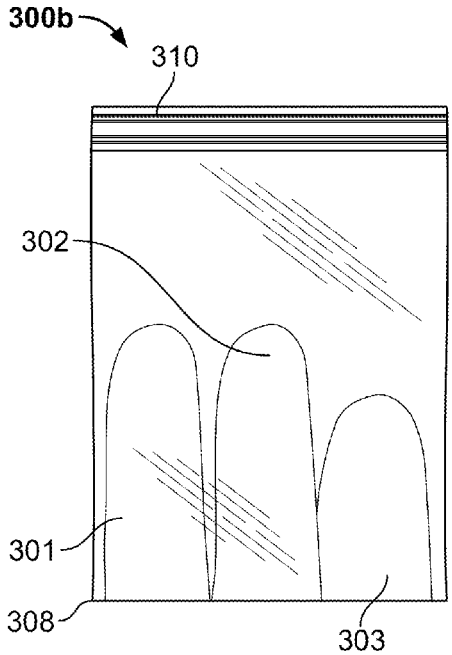
FIG. 3B illustrates a front view of a second example implementation of a re-closable bag including integrated finger sleeves.
Figure 3C:
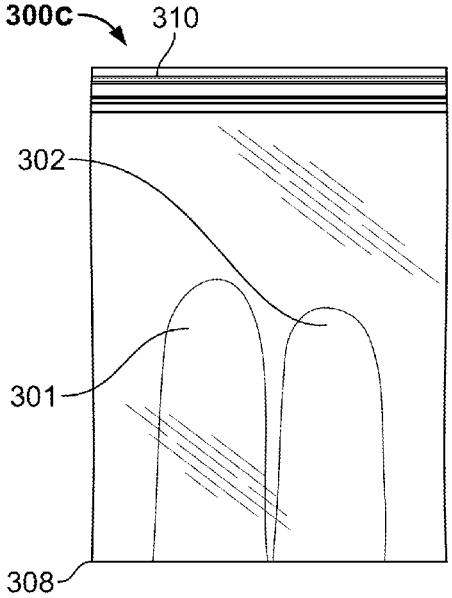
FIG. 3C illustrates a front view of a third example implementation of a re-closable bag including integrated finger sleeves.
Figure 3D:
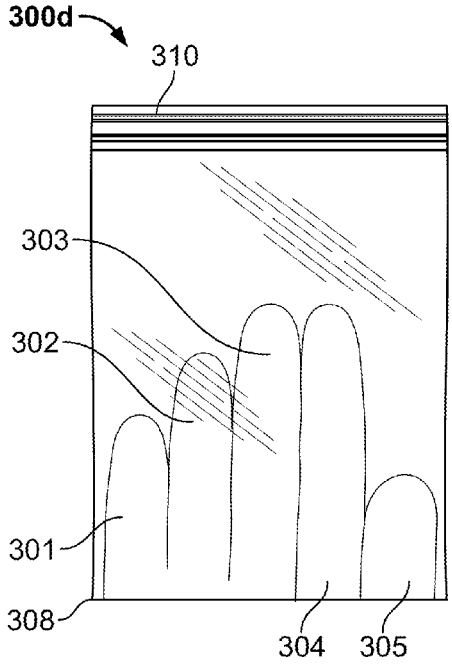
FIG. 3D illustrates a front view of a fourth example implementation of a re-closable bag including integrated finger sleeves.
Figure 3E:
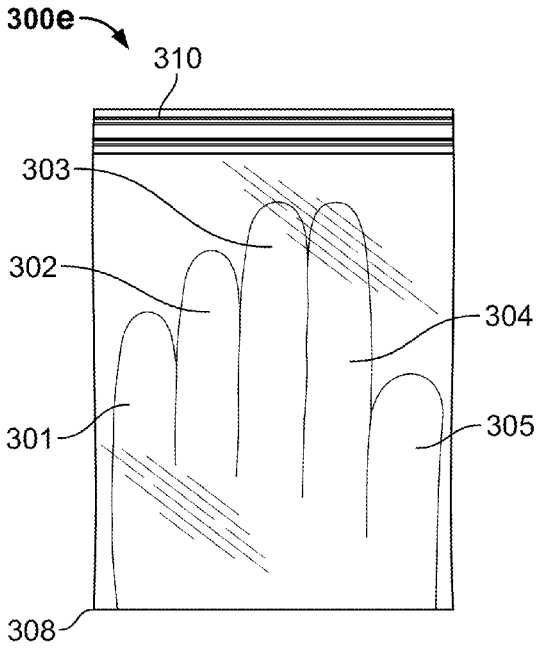
FIG. 3E illustrates a front view of a fifth example implementation of a re-closable bag including integrated finger sleeves.
Figure 3F:
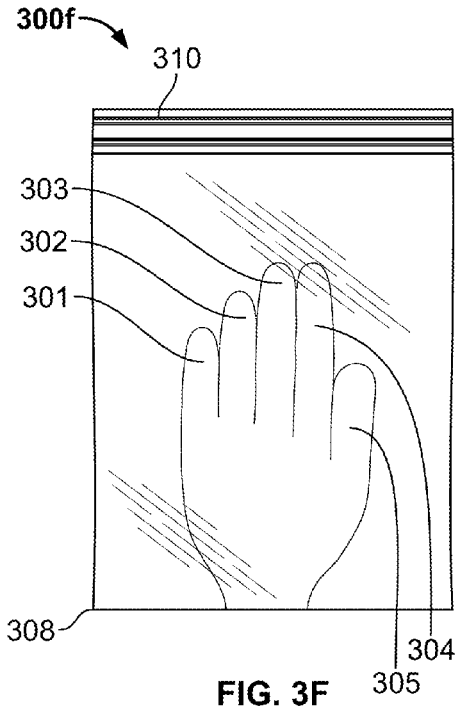
FIG. 3F illustrates a front view of a sixth example implementation of a re-closable bag including integrated finger sleeves.

In another example, shown in FIG. 3B, the lengths of the finger sleeves 301, 302, 303 integrated in the bag 300*b* can vary in length to accommodate particular fingers. For instance, in FIG. 3*b*, one of the finger sleeves 303 can be shorter and correspond to a user's thumb, with the remaining two finger sleeves 301, 302 adapted for a user's middle and index fingers respectively. In a third example, shown in FIG. 3C, a bag 300*c* can include two finger sleeves 301, 302 adapted to accept a user's index finger and thumb, respectively. The two-finger implementation shown in FIG. 3C can accommodate an overall smaller (i.e., narrower) bag size (e.g., adapted to contain smaller objects and for ease of carrying), while still allowing a user to grip objects with a thumb-index finger grip. Some implementations of a re-closable bag can include five integrated finger sleeves to allow for use with all of the fingers of a user. For example, in FIG. 3D, a bag 300*d* is shown including five finger sleeves 301, 302, 303, 304, 305 adapted to accept at least a portion of five fingers of a user. In still another example, shown in FIG. 3E, a bag 300*e* is provided that is adapted to receive, not only all five fingers, but the entire hand and a portion of the forearm of a user. The implementation of FIG. 3E can allow for a larger bag 300*e* that can be used in instances that involve grasping, capturing, and containing large objects as well as applications that warrant covering and isolating larger portions of the user's hand and arm, such as surgical or emergency response applications. Indeed, as shown in FIG. 3F, a re-closable bag 300*f* with integrated finger sleeves 301, 302, 303, 304, 305, and in some cases, a full integrated glove, can be provided with a bottom edge 330 wider than the integrated finger sleeves, to allow for storage of larger objects in the bag 300*f*.

Figure 3G:
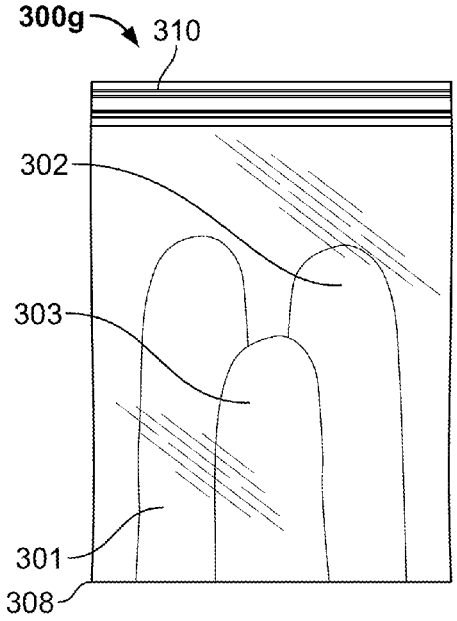
FIG. 3G illustrates a front view of a seventh example implementation of a re-closable bag including integrated finger sleeves.

While each of the example implementations shown in FIGS. 3A-3F show two or more finger sleeves arranged in a single row, in other examples, one or more finger sleeves can overlap other finger sleeves integrated in the bag to effectively form multiple rows of finger sleeves. For example, as shown in FIG. 3G, a bag 300*g* is provided with two finger sleeves 301, 302 arranged in a first row, with a third finger sleeve 303 at least partially overlapping one or more of finger sleeves 301, 302 to form a second row. Such sleeve configurations can be useful, for instance, so as to emphasize a certain finger grip intended for the bag, such as an index-middle-thumb grip accommodated by a configuration similar to that shown in FIG. 3G. Overlapping the finger sleeves integrated in the bag can also assist in making the profile, or width, of the bag smaller, such as in bag 300*g*, allowing for three fingers to be received in finger sleeves 301, 302, 303 while maintaining a width narrower than the combined width of three fingers.

Figure 3H:
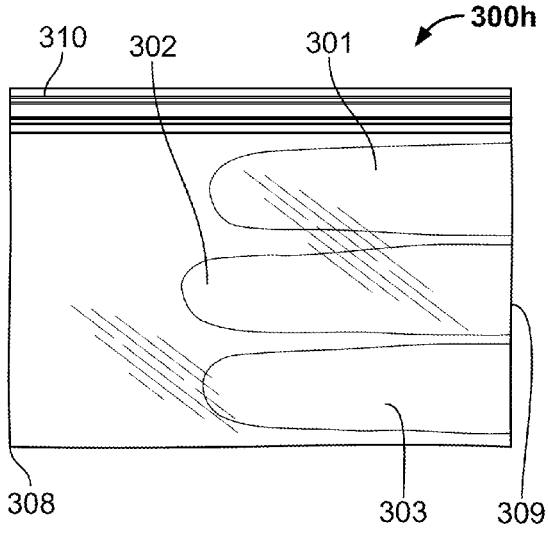
FIG. 3H illustrates a front view of an eighth example implementation of a re-closable bag including integrated finger sleeves.

Further, while the examples illustrated in FIGS. 3A-3G show finger sleeves integrated or joined to a bottom end 308 of the bag (i.e., opposite an opening of the bag having a closure 310), in some instances, finger sleeves can be integrated at other locations on the bag, including a side edge of the bag or on the side panel itself. As one example, FIG. 3H shows a bag 300*h* including finger sleeves 301, 302, 303 integrated on a side edge 309 of the bag 300*h*, with the finger sleeves extending substantially parallel to the opening of the bag, as well as closure 310 and bottom end 308. FIGS. 3A-3H show but some example implementations of a bag including two or more integrated finger sleeves. Other configurations and implementations can also be realized without departing from the subject matter described herein.

A re-closable bag including integrated finger sleeves can be made of a wide variety of suitable materials, methods of manufacture, as well as combinations of materials and manufacturing methods. For instance, all or part of a re-closable bag including integrated finger sleeves, such as the examples shown and described above, can be constructed of vinyl, nitrile, latex, polyethylene, polylactide, silicon, and other organic and synthetic flexible sheeted materials including other materials exhibiting elastomeric characteristics. Additionally, in some instances, biodegradable materials can be used in the construction of a re-closable bag including integrated finger sleeves. Further, in some implementations, it can be desirable to construct the finger sleeves and other portions of the bag, adapted to grip and hold an object, out of material that is more pliable, flexible, and tacky, allowing the user to retain dexterity and a non-slip grip on the object. The thickness of the material sheet can also be adapted for the finger sleeves with a thinner sheet provided in the finger sleeves to assist the user in retaining a level of tactile sensation, to better control manipulation and handling of the object, when fastened by the user's sleeve-wrapped fingers. Additionally, in some implementations, materials can be used that possess acceptable durability and strength, so as to protect against the bag or finger sleeves being ripped, torn, or pierced. As an example, to remove some dental appliances, the tip of a user's fingernail is often relied upon to dislodge the appliance from the user's teeth. To accommodate this use, finger sleeves integrated into the bag can be of a material (and thickness) possessing sufficient strength to withstand pinching of the finger sleeve material between the user's fingernail and the hard surface of the user's teeth or the dental appliance. Durable, and in some cases semi-rigid material can also be used to implement side panels of the bag, to provide enhanced protection for contents placed within the bag. Other material properties can be considered as well. For instance, in some implementations, all or a portion of the bag can be made of a substantially transparent film, allowing a user, for example, to identify the contents of the bag. Further, an outer surface of the bag can be adapted to be printed or written upon, for example, through use of a screen printing apparatus. In some examples, the name of the bag's (and/or the bag content's)

owner, doctor, or manufacturer can be printed on the outside of the bag, allowing the owner (such as the owner of a lost dental retainer) to be identified and contacted. Printing on the bag can also allow the bags to be personalized, branded, or aesthetically-enhanced.

In some applications, the desired characteristics of the finger sleeves and bag portions can differ. Accordingly, in some instances, the finger sleeves and bag sections can be constructed of different materials and bonded or otherwise joined together to form a water-tight joint between the sleeves and bag panels. In other instances, the entirety of the re-closable bag with integrated finger sleeves can be formed from a single material. Indeed, in some implementation, a bag with integrated finger sleeves can be manufactured from a single mold. In other examples, multiple sheets of a material can be bonded together to form a bag with integrated finger sleeves. For instance, a bag with integrated finger sleeves can be formed from two sheets, each including a portion of a side panel and at least one finger sleeve. Further, depending on the closure used in the re-closable bag with integrated sleeves, manufacture of the bag itself can include manufacture of the closure as well, such as molding or bonding a zipper closure onto panels of the bag. In other instances, the closure can be added following the manufacture of the bag and finger sleeves, such as in examples using an adhesive or static cling material added to the interior panels of the bag.

Figure 4A:
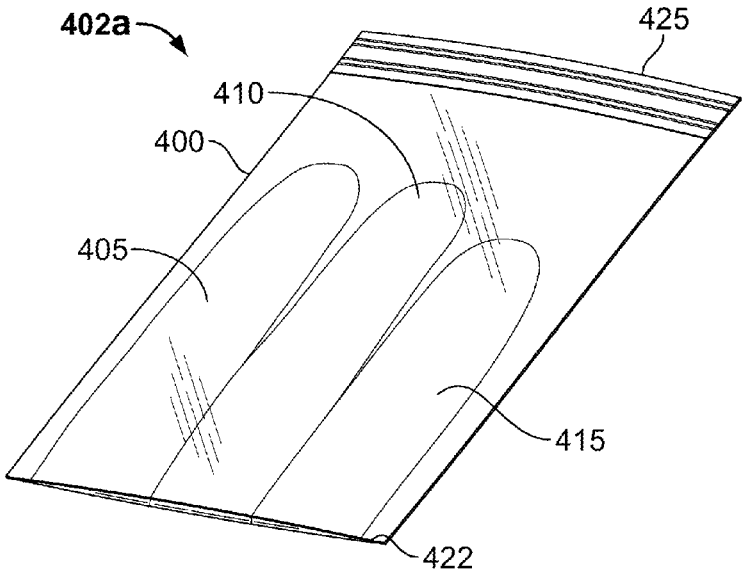
FIGS. 4A and 4B illustrate perspective views of an example re-closable bag, including integrated finger sleeves, adapted to fold flat in a first position.
Figure 4B:
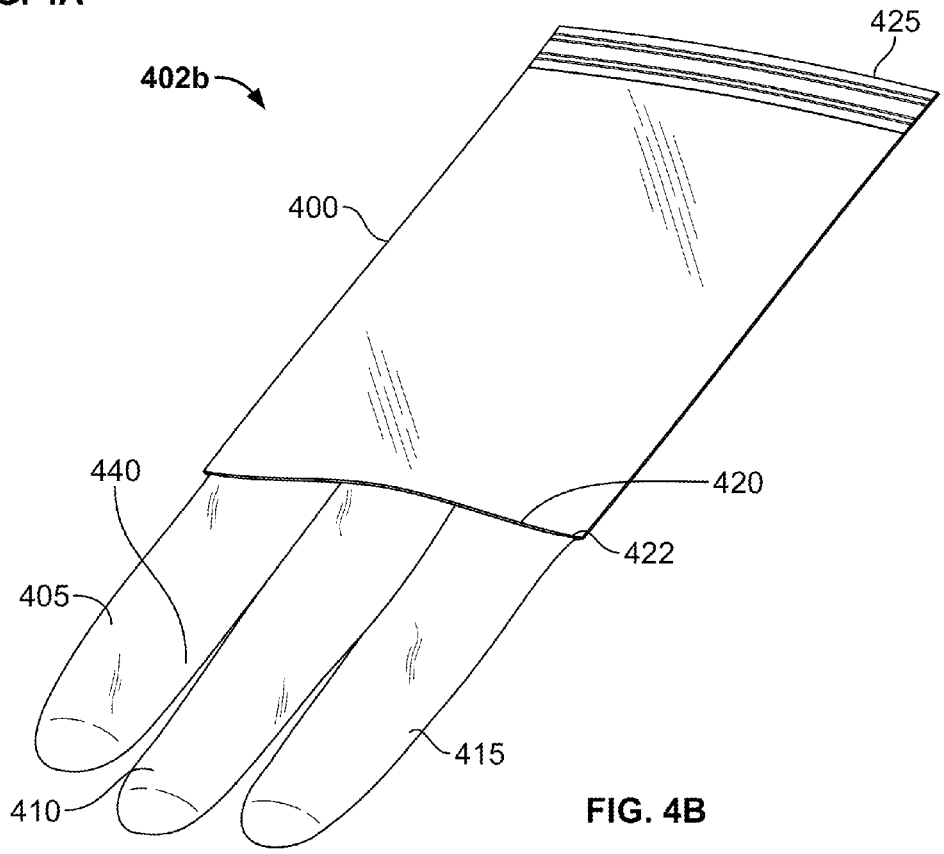

FIGS. 4A-4B illustrate perspective views of an example re-closable bag 400, including integrated finger sleeves 405, 410, 415, adapted to fold flat in a first position 402*a*. In some instances, the example re-closable bag 400 can be manufactured to include one or more folds, seams, pleats, or gusseted panels adapted to encourage the bag 400, at rest, to retain a first position 402*a*. With the bag 400 folded flat, multiple bags can be stacked flat, folder together, and/or efficiently stored and packaged. FIG. 4B shows a bag 400 in a second position 402*b* with integrated finger sleeves 405, 410, 415 turned inside-out. As shown in FIG. 4B, a fold 420 can be formed to extend across a bottom edge 422 of the bag, to bias a section of the bag 400 including the finger sleeves 405, 410, 415 to remain between side panels of the bag, with the finger sleeves pointing toward the bag's opening 425 (as in position 402*a*). In some instances, additional folds (e.g., 440), such as gusseted folds, can also be included along the outside edges of the integrated finger sleeves 405, 410, 415, to encourage the finger sleeves, when in the first position 402*a*, to lie flat and allow the bag 400 to be folded and stored flat and neatly, as shown in FIG. 4A.

A number of embodiments of the invention have been described. Nevertheless, it will be understood that various modifications may be made without departing from the spirit and scope of the invention. Accordingly, other embodiments are within the scope of the following claims.

What is claimed is:

1. A re-closable bag comprising:

a flexible side panel;

an opening on a top end of the bag, the opening including a closure adapted, when closed, to seal the bag;

at least two flexible finger sleeves connected to the side panel, wherein the finger sleeves, in a first position, are disposed between a first portion and a second portion of the side panel, and are each adapted to accept at least a portion of a human finger;

an interior surface, including an interior surface of the side panel and the at least two finger sleeves; and a coating disposed on at least a portion of the interior surface, the coating adapted to transfer, at least partially, to an article placed within the bag.

2. The re-closable bag of claim 1, wherein the finger sleeves, in a second position, extend from a bottom end of the bag substantially toward the opening.

3. The re-closable bag of claim 1, wherein the finger sleeves, in a second position, extend from a side end of the bag substantially parallel with the opening.

4. The re-closable bag of claim 1, wherein the at least two finger sleeves comprise three finger sleeves.

5. The re-closable bag of claim 1, wherein the at least two finger sleeves comprise five finger sleeves.

6. The re-closable bag of claim 1, wherein the at least two finger sleeves including a first finger sleeve and a second finger sleeve, wherein the first finger sleeve is longer than the second finger sleeve.

7. The re-closable bag of claim 1, wherein each of the at least two finger sleeves is adapted to accept less than an entire human finger.

8. The re-closable bag of claim 1, wherein the coating is a flavored powder.

9. The re-closable bag of claim 1, wherein the coating is an antiseptic powder.

10. The re-closable bag of claim 1, wherein the at least two finger sleeves are made of material including at least one of vinyl, nitrile, or latex film.

11. The re-closable bag of claim 1, wherein the at least two finger sleeves are made of a first material and at least a portion of the side panel is made from a second material different from the first material.

12. The re-closable bag of claim 11, wherein the at least two finger sleeves are joined to the side panel to form the bag.

13. The re-closable bag of claim 1, wherein the at least two finger sleeves are formed from at least one unitary sheet of material, and at least a portion of a particular finger sleeve is made from the same unitary sheet of material from which at least a portion of the side panel is made.

14. The re-closable bag of claim 1, wherein the side panel comprises at least a first side panel and a second side panel.

15. The re-closable bag of claim 1, wherein the closure is a re-closable closure.

16. The re-closable bag of claim 15, wherein the closure is a resealable closure.

17. The re-closable bag of claim 15, wherein the re-closable closure includes an interlocking male part disposed on the inside surface of the panel proximate to the top end of the bag and an interlocking female part disposed on the inside surface of the panel proximate to the top end of the bag, wherein the male part is adapted to couple with the female part to seal the bag.

18. The re-closable bag of claim 16, wherein the re-closable closure includes an adhesive strip adapted to temporarily seal the opening.

19. The re-closable bag of claim 1, wherein the bag is adapted to be folded substantially flat with the at least two finger sleeves in the first position.

20. A method comprising:

accepting at least two human fingers in at least two flexible finger sleeves integrated into a re-closable bag, the re-closable bag further including a flexible side panel, an opening on a top side of the bag, the opening including a re-closable closure adapted, when closed, to seal the bag, wherein the at least two flexible finger sleeves are connected to the side panel, and each finger sleeve, upon accepting one of the at least two human fingers, extend from a bottom side of the bag substantially toward the opening and are disposed between a first portion and a second portion of the side panel;

extending the at least two flexible finger sleeves in a direction toward and at least partially through the opening to grasp an article;

retracting the at least two flexible finger sleeves grasping the article in a direction toward the bottom side of the bag so as to pass the article through the opening and position the article between the first portion and the second portion of the side panel;

closing the re-closable closure to seal the article within the bag; and transferring at least a portion of a coating disposed on an interior surface of the bag to an exterior surface of the object in contact with the interior surface of the bag.

21. The method of claim 20, wherein the coating is transferred to the article while the article is sealed within the bag.

22. The method of claim 20, wherein the article is a removable dental appliance.

23. A glove comprising:

a water-tight body including:

an inner surface;

an outer surface;

at least two inverted elastomeric finger sleeves each having an inner and an outer surface, each finger sleeve adapted to accept at least a portion of a human finger in contact with the outer surface of the finger sleeve; and a re-closable opening in the body including a closure adapted to seal an interior volume of the glove enclosed by at least a particular portion of the inner surface of the body when closed; and a coating disposed on at least a portion of the particular portion of the inner surface, the coating to transfer, at least partially, to articles positioned within the interior volume.

24. The glove of claim 23, wherein the body includes three finger sleeves.

25. The glove of claim 23, wherein the closure is a re-closable closure including an interlocking male part disposed on a first portion of the inner surface of the body proximate to the opening of the glove and an interlocking female part disposed on a second portion of the inner surface of the body to the top side of the bag, wherein the male part is adapted to couple with the female part to seal the interior volume of the glove.

26. The glove of claim 25, wherein an area of the outer surface is textured proximate to a tip of at least one of the finger sleeves, wherein the textured area is adapted to grip a surface having a low coefficient of friction.

27. A method comprising:

accepting at least two human fingers in at least two flexible finger sleeves integrated into a re-closable bag, the re-closable bag further including a flexible side panel, an opening on a top side of the bag, the opening including a re-closable closure adapted, when closed, to seal the bag, wherein the at least two flexible finger sleeves are connected to the side panel, and each finger sleeve, upon accepting one of the at least two human fingers, extend from a bottom side of the bag substantially toward the opening and are disposed between a first portion and a second portion of the side panel;

extending the at least two flexible finger sleeves in a direction toward and at least partially through the opening to grasp an article;

retracting the at least two flexible finger sleeves grasping the article in a direction toward the bottom side of the bag so as to pass the article through the opening and position the article between the first portion and the second portion of the side panel; and closing the re-closable closure to seal the article within the bag, wherein the article comprises a dental appliance.

* * * * *